United States Patent [19]

Dugge et al.

[11] Patent Number: 4,568,224

[45] Date of Patent: Feb. 4, 1986

[54] FLUIDIZING OUTLET ASSEMBLY INCLUDING INTERNAL TROUGH

[75] Inventors: Richard H. Dugge, St. Louis; James C. Hammonds, St. Charles, both of Mo.

[73] Assignee: ACF Industries, Incorporated, Earth City, Mo.

[21] Appl. No.: 226,972

[22] Filed: Jan. 21, 1981

Related U.S. Application Data

[63] Continuation of Ser. No. 104,347, Dec. 17, 1979, abandoned.

[51] Int. Cl.[4] ..... B65G 53/40

[52] U.S. Cl. ..... 406/90

[58] Field of Search ..... 406/89, 90, 91, 119, 406/136, 138, 145, 129, 130; 222/195; 366/101, 107

[56] References Cited

U.S. PATENT DOCUMENTS

| | | | |
|---|---|---|---|
| 2,950,143 | 8/1960 | Koranda et al. | 406/145 |
| 3,191,785 | 6/1965 | Price | 406/122 X |
| 3,302,979 | 2/1967 | Rollins et al. | 406/91 |
| 3,325,223 | 6/1967 | Price | 406/145 |
| 3,328,091 | 6/1967 | Fritz | 406/145 |
| 3,393,017 | 7/1968 | Smith | 406/130 |
| 3,843,204 | 10/1974 | Fischer | 406/145 |
| 3,876,261 | 4/1975 | Sucius et al. | 406/129 |
| 4,015,751 | 4/1977 | Rollins et al. | 406/90 |

FOREIGN PATENT DOCUMENTS

| | | | |
|---|---|---|---|
| 5516033 | 1/1958 | Canada | 406/131 |
| 877044 | 9/1961 | United Kingdom | 406/145 |

*Primary Examiner*—Jeffrey V. Nase

*Attorney, Agent, or Firm*—Polster, Polster and Lucchesi

[57] ABSTRACT

A hopper is provided having longitudinally spaced tapered end walls and transversely spaced tapered side walls. An opening is provided in one of the end walls and a discharge conduit is attached to the external surface of this end wall. On the internal surface of this end wall a discharge trough is attached. The front surface of the trough is tapered on the same incline as this end wall. Fluidizing membrane assemblies are attached to each of the side walls which are inclined downwardly toward the discharge conduit to facilitate lading flowing into the discharge conduit during unloading. The discharge trough is generally in the form of an inverted V, with the lower edges of the V spaced from the lower hopper wall a distance sufficient to allow air and lading to pass around the trough and into the discharge trough. The lower edges of the V are preferably tapered inwardly and downwardly toward the end wall to increase the velocity of the fluidized lading as it passes into the trough and then into the discharge conduit.

2 Claims, 5 Drawing Figures

FLUIDIZING OUTLET ASSEMBLY INCLUDING INTERNAL TROUGH

This is a continuation of application Ser. No. 104,374 filed Dec. 17, 1979 now abandoned.

BACKGROUND OF THE INVENTION

In U.S. Pat. No. 2,950,143 in a gravity-pneumatic outlet a hood is provided in which the lower edges of the hood are spaced from the top of the gravity gate a distance sufficient for air and lading to enter the hood and be discharged through a pneumatic discharge conduit.

In U.S. Pat. No. 3,328,091 in a pneumatic outlet a hood is disclosed in which the lower edges of the hood are spaced from the outlet pan a distance to allow air and lading to enter the hood and be discharge pneumatically through a discharge conduit.

In U.S. Pat. No. 3,191,785, a plate located on the discharge conduit may be adjusted to control the velocity of air and lading entering the discharge conduit.

In U.S. Pat. No. 3,393,017 in a gravity pneumatic outlet a plurality of pyramid-shaped tapered walls are used to guide air and lading downward and into a pneumatic discharge conduit.

In U.S. Pat. No. 4,015,751, assigned to the same assignee as the present application, a fluidizing outlet includes a pair of removable porous membranes mounted within an outlet pan having opposed inclined bottom portions which terminate in a pneumatic discharge conduit extending longitudinally of the car.

SUMMARY OF THE INVENTION

The object of the present invention is to provide a fluidizing outlet assembly which achieves essentially complete unloading with very minimal contamination remaining in the outlet.

Another object of the invention is to provide an outlet assembly which is adapted for use in hoppers operating at pressures of up to 15 psi and higher.

In accordance with the present invention a hopper is provided having longitudinally spaced tapered end walls and transversely spaced tapered side walls. An opening is provided in one of the end walls and a discharge conduit is attached to the internal surface of this end wall. On the internal surface of the end wall a discharge trough is attached. The front surface of the trough is tapered on the same incline as the front wall and is rigidly attached to the front wall. In order to provide an inclined surface for fluidizing the lading, the lower edges of the transversely spaced side walls are inclined inwardly and downwardly toward the discharge conduit.

Fluidizing membrane assemblies are attached to each of the side walls which are in turn inclined downwardly toward the discharge conduit to facilitate lading flowing into the discharge trough during unloading.

The discharge trough is generally in the form of an inverted V, with the lower edges of the V spaced from the bottom hopper wall a distance sufficient to allow air and lading to pass around the trough and into the discharge conduit. The lower edges of the V are preferably tapered inwardly and downwardly to increase the velocity of the fluidized lading as it passes into the trough and then into the discharge conduit.

The discharge trough preferably terminates inboard of the adjacent hopper end wall to allow air and lading to enter from this end of the discharge trough and prevent large pieces from being trapped below the discharge trough.

THE DRAWINGS

DESCRIPTION OF PREFERRED EMBODIMENTS

Figure 2:
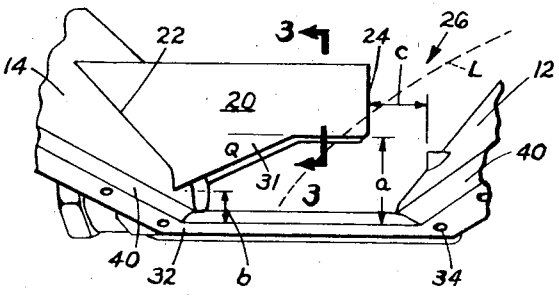
FIG. 2 is a perspective view of the discharge trough in place with one of the fluidizing assemblies removed.

In the drawings a hopper 10 is provided with end slope sheets 12 and 14. In addition, side walls 15 and 16 are also provided. A discharge conduit 18 is attached to an pening in the hopper wall 14. As shown in FIG. 2, a discharge trough 20 is welded to the internal surface of the wall 14. The trough 20 has an inclined surface 22 which corresponds to the shape of the hopper wall 14. The inner end 24 of the discharge trough is longitudinally spaced from the hopper wall 12.

The hopper walls 15 and 16 are cut off to define inclined surfaces 17 and **17*a* tapered inwardly and downwardly toward the discharge conduit 18 and the discharge trough 20. Fluidizing assemblies 26 and 28 are attached to the hopper walls 12, 14, 17, 17*a* to fluidize the lading and direct the fluidized lading inwardly and downwardly toward the trough 20 and discharge conduit 18**.

Figure 3:
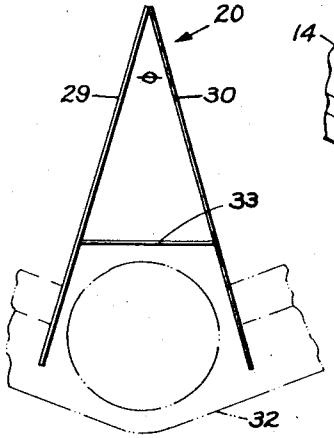
FIG. 3 is a sectional view looking in the direction of the arrows along the line 3—3 in FIG. 2.
Figure 1:
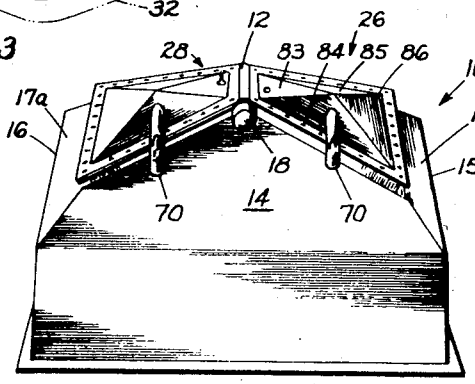
FIG. 1 is a perspective view of the fluidizing outlet assembly of the present invention in which the hopper and fluidized membranes are turned upside down.

As shown in FIG. 3, the trough 20 is generally in the form of an inverted V having inclined walls 29 and 30 with lower edges 31 spaced from the bottom 32 of the hoppers a distance sufficient to allow fluidized lading moving inwardly and downwardly toward the discharge trough to pass into the discharge trough and out of the discharge conduit. A transverse reinforcement 33 is provided between walls 29 and 30. The angle $\theta$ between walls 29 and 30 is within about forty (40) to ninety (90) degrees. The distance "a" that the lower surface of the trough is located above the hopper bottom 32 is preferably four (4) to eight (8) inches. The angle of the angle $\theta$ in the V shaped member between the tapered portion and the main portion is preferably within about forty-five (45) to ninety (90) degrees. It is also noted that the surface 31 is tapered inwardly and downwardly toward the hopper wall 14. This causes an increase in the velocity of the fluidized lading below the tapered portion as it enters the trough. At the base of the inclined portion, the distance "b" between the end of the inclined portion and the bottom of the hopper 32 is preferably about two (2) inches.

The end 24 of the trough is terminated inboard of the adjacent hopper end wall 12 a distance C equal to two (2) to eight (8) inches. This avoids the tendency for large lumps to be trapped below the discharge trough, as would be the case in the event that the trough extends all the way across between the hopper end walls 12 and 14. Furthermore, shortcircuiting is reduced by the opening at the end of the discharge trough. The angle of fill of the lading L is shown in FIG. 2.

The respective fluidizing assemblies 26 and 28 are attached to the hopper end wall in a manner described in detail in Ser. No. 104,343 filed Dec. 17, 1979, now U.S. Pat. No. 4,280,706.

Figure 4:
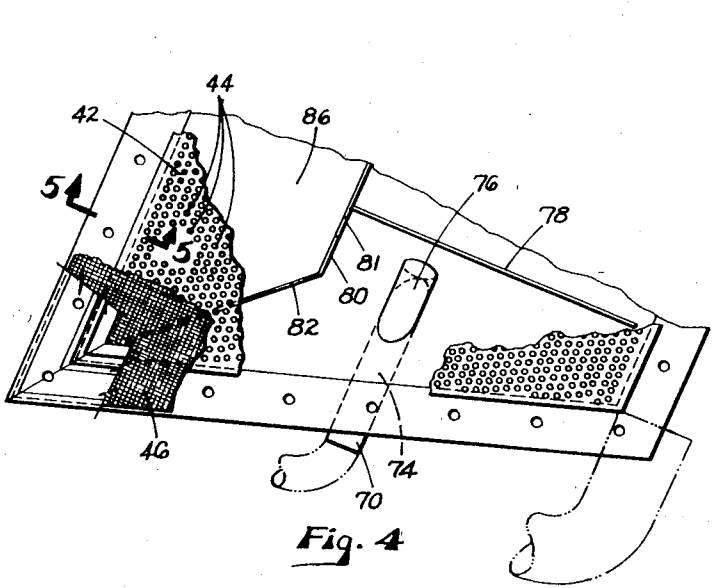
FIG. 4 is a partial plan view of one of the fluidizing membrane assemblies in the present application.
Figure 5:
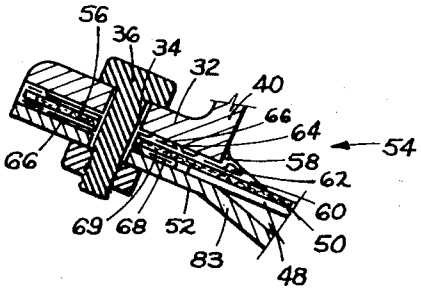
FIG. 5 is a sectional view looking in the direction of the arrows 5—5 in FIG. 4.

Briefly, the hopper mounting flange 32 includes openings therein 34 to receive fasteners 36 to hold the fluidizing membrane assemblies 26 and 28 in place. Each hopper wall also includes a vertical wall portion 40. A metal sheet 42 (FIG. 4) includes a plurality of openings 44 through which a fluidizing medium passes to fluidize the lading. A filter 46 is located upon the metal sheet. The metal sheet has an inner end 48 (FIG. 5) and the filter has an inner end 50 which is located between the outlet flange 32 and a fluidizing assembly flange 52.

A seal member indicated generally at 54 includes a body portion 56 located upon filter end 50 and below outlet flange 32. The seal includes a vertical projection 58 which engages the hopper wall portion 40. The seal further includes a tapered portion 60 which is tapered downwardly and inwardly from the projection 58 which terminates above the sheet inner end 50. It will be apparent that fluid pressure in the outlet will tend to urge the projection 58 into engagement with the vertical wall 40 and urge the tapered portion 60 into engagement with the filter inner end 50 to provide a tight seal.

In addition, a void space 62 may be provided located generally below the projection 58 which can be compressed to some extent during assembly to reduce inconsistencies and unevenness in the filter, the metal sheet or the flanges, and to ensure a tight seal between filter end 50 and hopper wall 40. In addition a projection 64 including a hollow portion 66 is located on body portion 56. The purpose of this projection 64 is to allow for discontinuities and unevenness in assembly when a fastener 36 is used to tighten the assembly of the hopper flange portion 32, the filter end 50, the seal 54 and the flange 52. A lower seal portion 66 is located below filter portion 50 conveniently including a projection 68 having an opening 69 which is compressed in assembly. Further details concerning the seal. assembly can be found in application Ser. No. 104,343 filed Dec. 17, 1979, now U.S. Pat. No. 4,280,706.

A pipe 70 is connected to a source (not shown) of fluidizing air. Pipe 70 includes a portion 74 extending horizontally into the outlet. An opening 76 at the inner end distributes the fluid into the outlet below sheet 42. An outlet stiffener 78 extends transversely of the outlet and transversely of the car. Another stiffener 80 extends perpendicular to stiffener 78 and includes a generally inclined portion 82. Stiffener 80 includes an opening 81 for fluid to pass through into compartment portion 86. Stiffeners 78, 80 and 82 support the metal sheet and the filter medium in the body portion of the outlet.

The fluidizing assemblies include tapered bottom walls 83, 84, 85 and 87. The assembly 28 is constructed in a similar manner on the other side of the outlet.

In operation, fluidizing air is introduced through pipe 70 into horizontal conduit 74 and into the outlet. The air passes through opening 81 in stiffener 80 to reach all parts of the outlet. The air passes up through the metal sheet openings 44 and through the filter member 46 to fluidize the lading. The lading is then directed downwardly and inwardly toward discharge trough 20. Lading enters trough 20 from below the trough and through the end 24. The velocity of lading entering below tapered portion 30 is increased. Large pieces tend not to be trapped below trough 20. They can move around due to the fluidizing air and tend to break up. The lading is removed through the conduit 18 and into a product line connected thereto. From here it is transferred into a container therefor.

What is claimed is:

1. A fluidizing outlet assembly comprising:

a hopper having longitudinally spaced tapered end walls and transversely spaced side walls; an opening on one of said end walls and a discharge conduit attached to the external surface of said one end wall; said end wall having an internal surface to which a discharge trough is attached; the front surface of said trough being tapered on the same incline as said one wall; said discharge trough being generally in the form of an inverted V, with the lower edges of the V spaced from the hopper bottom a distance sufficient to allow air and lading to pass around the trough and into the discharge trough; said transversely spaced side walls being tapered inwardly and downwardly on either side of the discharge conduit; fluidizing membrane assemblies attached to the tapered portion of each of said side walls; said fluidizing membrane assemblies being inclined inwardly and downwardly toward said discharge trough and discharge conduit to facilitate lading flow into said discharge trough during unloading; said discharge trough terminating inboard of the adjacent hopper end wall to provide a substantially unobstructed entry space between said discharge trough and said adjacent hopper end wall to allow air and lading to enter from this end of the discharge trough and prevent large pieces from being trapped below the discharge trough; and the lower edges of said V being tapered inwardly and downwardly to facilitate the flow of fluidized lading as it passed into said trough.

2. A fluidizing outlet assembly according to claim 1, wherein the angle in the V-shaped member between the tapered portion and the main portion is within about 45° to about 90°.

* * * * *